United States Patent [19]

Palmer

[11] 4,054,084

[45] Oct. 18, 1977

[54] FIRE AND SMOKE FREE SYSTEM FOR HIGH RISE BUILDING STAIRWAYS

[76] Inventor: William Francis Palmer, 14 E. Webster, Merrick, N.Y. 11566

[21] Appl. No.: 633,005

[22] Filed: Nov. 18, 1975

[51] Int. Cl.[2] ..... F24F 7/00

[52] U.S. Cl. ..... 98/39; 98/43 A; 169/61

[58] Field of Search ..... 98/43 A, 43 R, 39; 169/60, 61

[56] References Cited

U.S. PATENT DOCUMENTS

| | | | |
|---|---|---|---|
| 2,154,410 | 4/1939 | Polk | 98/43 |
| 3,715,968 | 2/1973 | Henson | 98/36 |
| 3,739,707 | 6/1973 | Knapp | 236/49 |
| 3,817,161 | 6/1974 | Koplon | 98/39 |
| 3,826,180 | 7/1974 | Hayashi | 98/43 |
| 3,884,133 | 5/1975 | Miller | 236/49 |
| 3,926,101 | 12/1975 | Moss | 98/33 R |
| 3,952,452 | 4/1976 | Hebda | 98/39 |

*Primary Examiner*—William E. Wayner
*Assistant Examiner*—Robert J. Charvat

[57] ABSTRACT

A fire and smoke free stairway in the event of fire in high rise buildings can be maintained by developing a velocity pressure of air through the fire doorway, from the fire stairway each time the door is opened during evacuation and without pressurizing the stairway significantly.

1 Claim, 5 Drawing Figures

FIRE AND SMOKE FREE SYSTEM FOR HIGH RISE BUILDING STAIRWAYS

SUMMARY OF INVENTION

This invention relates to fire safety in high rise buildings. An object of the invention is to improve methods of fire safety in high rise buildings by providing improved means and devices for maintaining fire and smoke free stairways for evacuation in the event of fire.

Other objects of the invention will be apparent from the following and accompanying drawing taken in connection with the appended claims.

DRAWING DESCRIPTION

FIG. 1 is a section through a stair shaft in a high rise building showing also part of the adjacent floor areas. The upper portion is a view of upper level floors in the vicinity of an upper level "mechanical equipment" room. The lower portion is a view near a grade level "mechanical equipment" room and showing several floors near grade level. Fire doors opened into the fire stairway are shown in dashed lines.

DESCRIPTION OF INVENTION

A system to maintain a smoke and fire free escape stairway is presented for buildings whose type of occupancy or height may mandate such means for evacuation in the event of fire to comply with local building codes.

Figure 1:
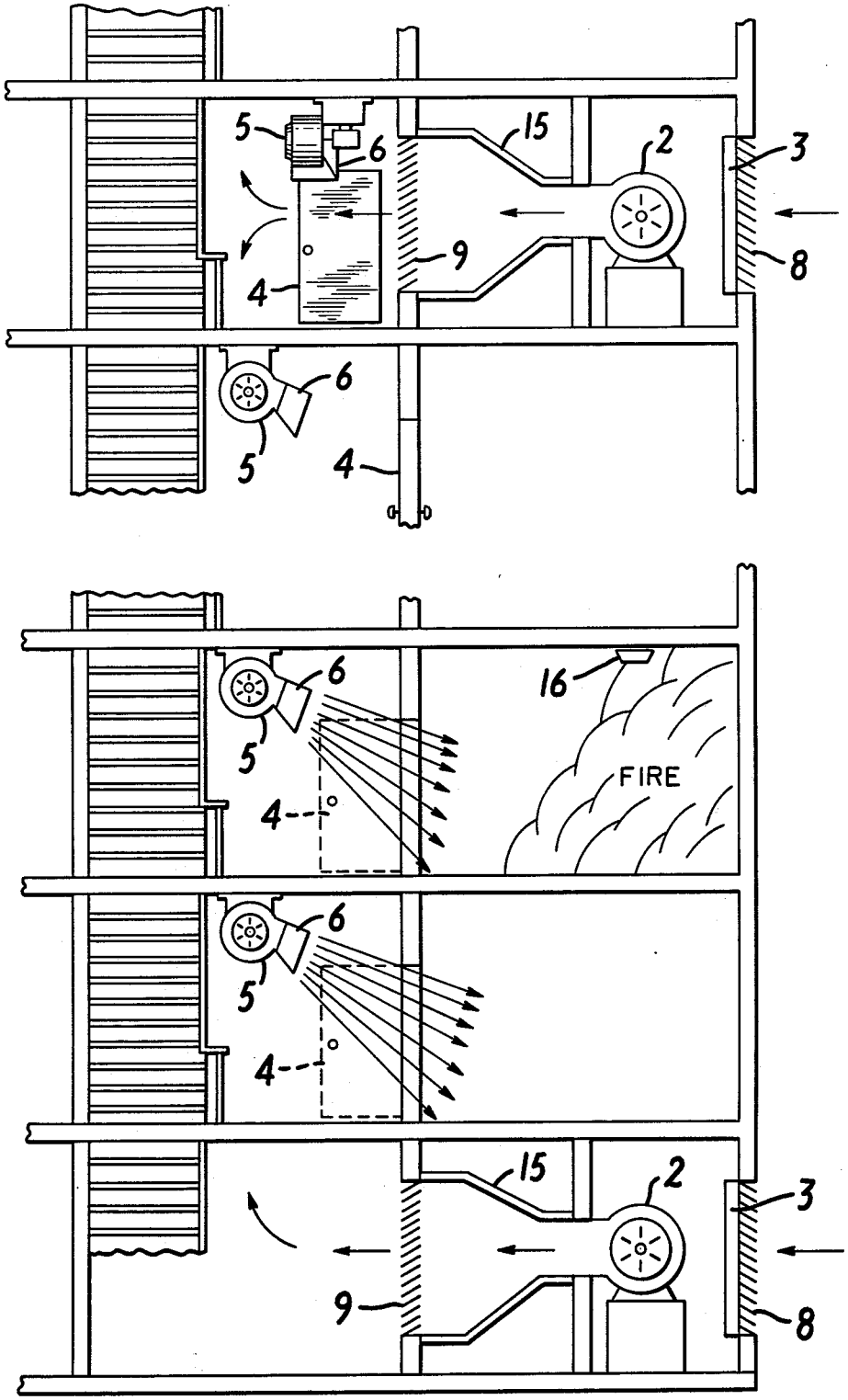
Figure 2:
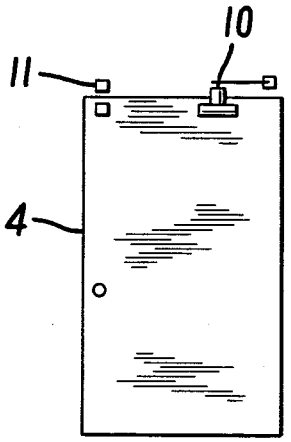
FIG. 2 is a view of a typical fire door.
Figure 3:
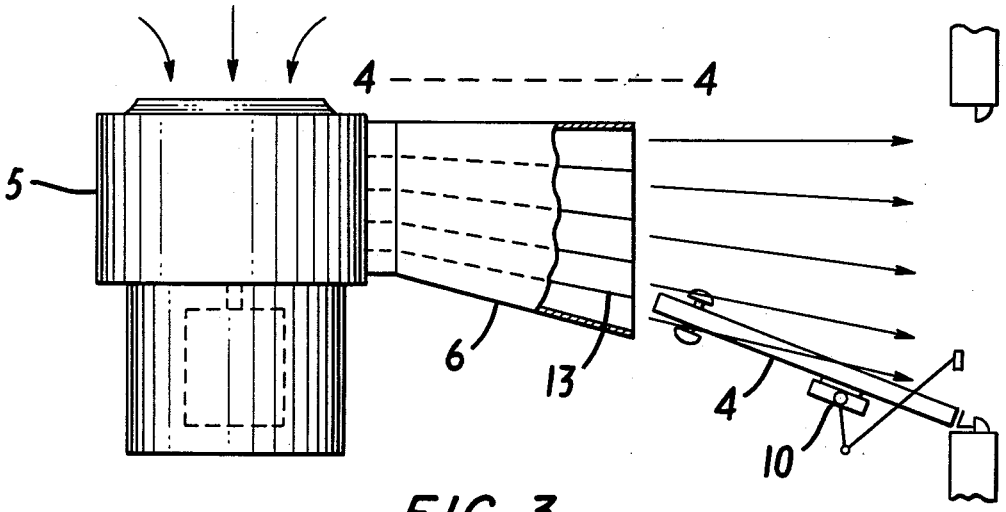
FIG. 3 is a plan view of a typical fan with nozzle located in the fire stairway and showing the air distribution thru the open fire door into the floor area.
Figure 4:
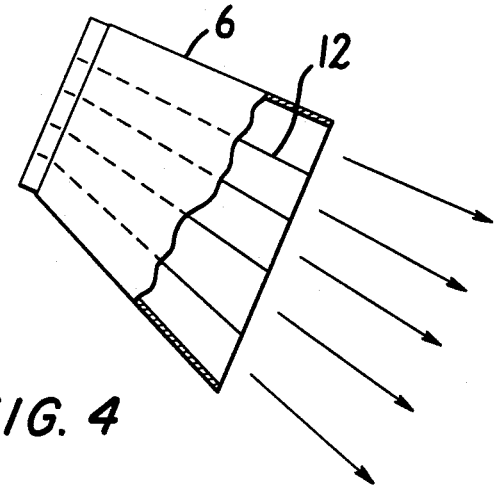
FIG. 4 is a section view from FIG. 3 showing the nozzle in elevation.

Referring to FIG. 1, there is shown a multi floor building having a star shaft and an entrance door 4 on each floor leading to the staircase. Said building having a first fan 2 for blowing outside air received through adjustable damper 3 having louver 8 to the stairshaft through a louver 9. A second fan means 5 is mounted on the ceiling of each floor near the entrance door 4 to the stairshaft. These fans are conveniently located in mechanical equipment areas where possible to avoid using productive space. Located in the stairway near the fire door entrance 4 to the stairway from each floor and positioned at an optimum angle is a fan 5 of sufficient capacity to direct a flow of air shaped by nozzle 6 with turning vanes 12 and 13 thru the open doorway into the floor area to drive heat and smoke back.

When a fire is detected in the building via smoke detectors 16 or the pulling of an alarm etc., the system would be activated initially as follows. Fresh air inlet dampers 3 to the outside air fans 2 would be opened and a roof vent at the top of the shaft would open. The outside air fans 2 would begin to supply a low quantity of air to the shaft thru louvers 8 and 9 via supply ducts with insulation 15 for sufficient fire rating.

Figure 5:
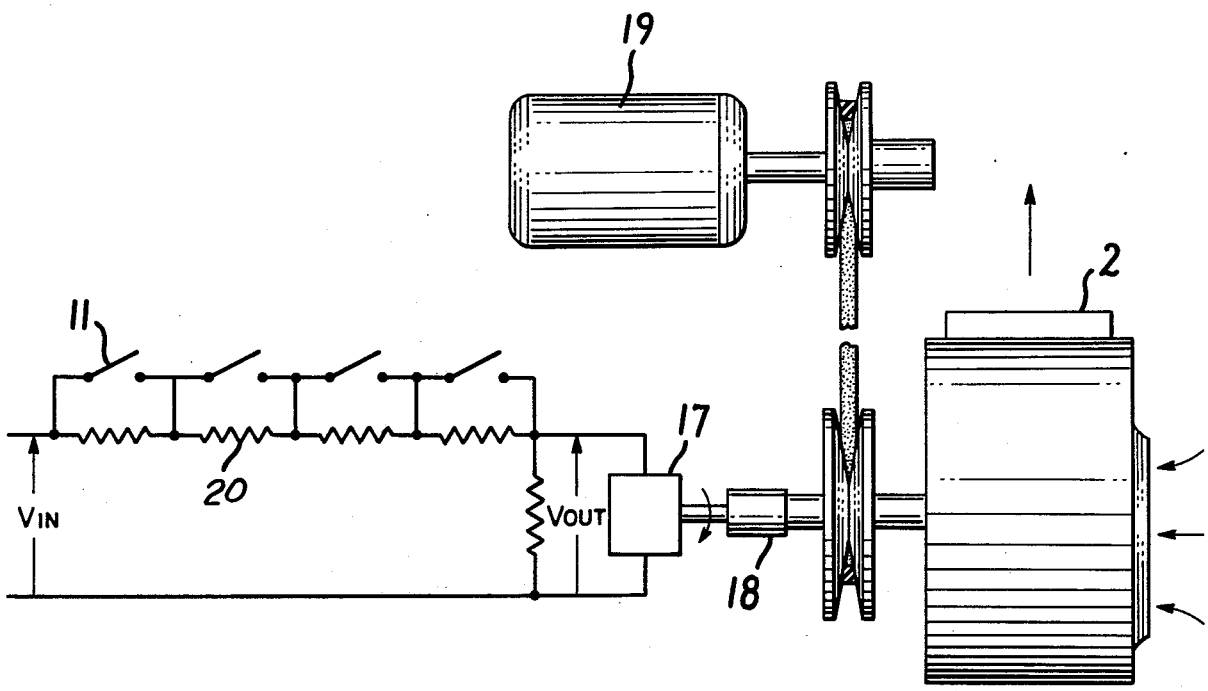
FIG. 5 is a schematic diagram of the outside air fan speed control.

Fan 5 operation at each floor would be started by a switch 11 which would be thrown only when the adjacent door 4 was opened by persons entering the stair shaft. Simultaneously, the outside air fan 2 would increase its output corresponding to the number of open doors 4 in its group of floors through coordination with the door switches 11. Outside air fan 2 output variation can be accomplished using a voltage divider network of series resistors 20, and door switches 11, a rotary solenoid 17 and a variable pitch pulley 18 installed on the fan shaft. Referring to FIG. 5, the resistors in series are each paralleled by a door switch 11. The door switches 11 are open when the fire doors 4 are closed and thus the voltage drop across the network will be a maximum and the voltage applied to the solenoid 17 will be a minimum. As fire doors 4 are opened, the voltage drop across the network decreases thus more voltage is applied to the solenoid 17, increasing the rotation of the solenoid output shaft. The rotary solenoid 17 thus will cause a rotation of the pitch diameter adjustment in the variable pitch pulley 18. A decreasing pitch diameter will increase the fan speed and fan output when connected to a constant speed electric motor 19. Thus fan output will closely match the amount of air being blown out of the stairshaft into the floor areas. This will prevent over pressurization of the stairway avoiding difficulty in opening doors.

To avoid short cycling of the fans and to provide sufficient scavaging of leaked smoke, the doors 4 could be fitted with an adjustment closer 10 to slow door closing.

This system would be superior to the ordinary stair pressurization schemes currently in vogue using one large fan at the lower level to pressurize the whole stair shaft. A velocity pressure is developed mechanically directly at the fire door. Air flow is thus developed and controlled easily to suit conditions at the floor level. Door opening difficulties associated with stair shaft pressurization are eliminated and the system is independent of pressure variations caused by opening of fire doors. For example, if the stair shaft were pressurized to the degree some recommend and several lower floor doors were opened simultaneously, the outrush of air would be enormous particularly if the building were very high, and the upper portions of the shaft would be starved for pressure. The key difference between this scheme and pressurization schemes is that fire and smoke can be kept out of the stairway without pressurizing the stairshaft. This avoids the need for door opening aids and eliminates the possibility of pressure variations or losses. Air supply and air discharge from the stairshaft are coordinated to avoid pressure buildup.

When the hazards of high rise occupancy are considered, an economic and reliable method of achieving safe evacuation of the buildings is imperative. The inventor believes that this invention will accomplish this goal.

I claim:

1. A fire control device to maintain a smoke and fire free escape from a multi-floor building having a stair shaft, comprising an entrance door to the stair shaft from each floor, a first fan supplying a variable quantity of external air, in proportion to the number of entrance doors open, to said stair shaft when activated, a second fan directing a flow of air through the doorway of said entrance door when said door is opened.

* * * * *